US005518127A

United States Patent [19]

Warmack et al.

[11] Patent Number: 5,518,127

[45] Date of Patent: May 21, 1996

[54] COMPACT MOBILE ROTISSERIE PREPARATION WORKSTATION

[75] Inventors: John L. Warmack, Louisville, Ky.; Frederick W. Henderson, Denver, Colo.; David A. Dodds, Louisville, Ky.

[73] Assignee: KFC Corporation, Louisville, Ky.

[21] Appl. No.: 262,612

[22] Filed: Jun. 20, 1994

[51] Int. Cl.[6] ..... A47F 7/00

[52] U.S. Cl. ..... 211/193; 180/25; 280/79.3; 99/419; 126/25 R; 126/276

[58] Field of Search ..... 211/193, 208, 211/206; 108/25, 26, 31; 126/9 R, 25 R, 29, 30, 41 R, 276; 99/419, 422; 280/79.3

[56] References Cited

U.S. PATENT DOCUMENTS

| | | | |
|---|---|---|---|
| 3,359,887 | 12/1967 | Cleveland | 126/29 X |
| 3,442,202 | 5/1969 | Ishida | 126/25 R X |
| 3,757,671 | 9/1973 | Warshauer et al. . | |
| 3,887,253 | 6/1975 | Bridges et al. . | |
| 4,270,444 | 6/1981 | Geissmann . | |
| 4,297,942 | 11/1981 | Benson et al. . | |
| 4,421,017 | 12/1983 | Ross . | |
| 4,572,061 | 2/1986 | Masters . | |
| 4,595,107 | 1/1986 | Welsch . | |
| 4,691,626 | 9/1987 | Shih-Cheng . | |
| 4,813,572 | 3/1989 | Schmidt . | |
| 4,829,977 | 5/1989 | Valentine | 126/30 X |
| 4,893,553 | 1/1990 | Emsens . | |
| 4,923,202 | 5/1990 | Breveglieri et al. . | |
| 4,934,280 | 6/1990 | Bae | 108/25 X |
| 4,984,515 | 1/1991 | Pivonka | 126/30 X |
| 4,998,023 | 3/1991 | Kitts . | |
| 5,020,867 | 6/1991 | McManus . | |
| 5,033,365 | 7/1991 | Rao et al. . | |
| 5,033,366 | 7/1991 | Sullivan . | |
| 5,125,607 | 6/1992 | Pryor . | |

*Primary Examiner*—Robert W. Gibson, Jr.
*Attorney, Agent, or Firm*—Covington & Burling

[57] ABSTRACT

A mobile workstation for preparation of skewered meat products comprising a mobile food preparation cart, a skewer bracket and a rack member. The cart has a work surface or horizontal supports supported by a plurality of leg supports on wheels and rails for supporting a removable seasoning lug positioned below said work surface. The skewer bracket is mounted on the food preparation cart and receives and positions a skewer in a substantially vertical position for effecting skewering of a meat product thereon. The rack member, which also supports a plurality of skewers or skewers and skewered meat products, is also mounted on the food preparation cart.

20 Claims, 7 Drawing Sheets

COMPACT MOBILE ROTISSERIE PREPARATION WORKSTATION

FIELD OF THE INVENTION

The present invention is directed to the field of compact, mobile workstations for the preparation of skewered meat products and, particularly, a food preparation workstation adapted for the preparation of chicken for the rotisserie.

BACKGROUND OF THE INVENTION

Rotisserie and barbecue cooking using skewers are popular means to cook meat products, particularly chicken. The meat product is cooked without substantial desiccation. Since the surface of the meat product is quickly seared to seal in meat juices, the tastiness and juiciness of the meat product are enhanced.

Apparatus to effect rotisserie cooking have been in use in the art. Such types of apparatus typically comprise a grilling space defined by metal walls and one or more access doors provided with a window of heat-resistant glass, motor-driven rotatable spits or similar means for supporting the meat to be cooked arranged outside said space, and heating means for heating said meat to the required temperature, said heating means being formed by, generally electric heat radiation or similar gas elements which are positioned in such a manner that the meat rotated on the spits is cooked thereby, while rotating said spits.

Such apparatus can be used for cooking larger pieces of meat such as whole chickens. However, there are several disadvantage which have been associated with the preparation of the meat products to be cooked in this manner and, particularly, skewering the product.

Typically, the meat product needs to be prepared for cooking, skewered, seasoned and then moved to the oven area. Each of these steps needed to be carried out in a separate area of the kitchen which needed to be cleaned after every instance to avoid contamination of any subsequent product set down in the area. The rotisserie ovens in the quick serve restaurant industry utilize relatively long skewers of approximately 28" in length rendering it difficult to place meat products therein without anchoring one end of the skewer or utilizing two persons. Conventional kitchen equipment often is not equipped to anchor such skewers and, further, not capable of sustaining the forces associated with skewering products.

In U.S. Pat. No. 4,893,553 a machine for the automatic production of meat products threaded onto skewers is disclosed. However, the typical quick serve restaurant has a crowded kitchen which does not have the capacity for such automation. Furthermore, the automation of one task, skewering, does not resolve the problems of contaminating surfaces with meat juices and preparing the meat product for skewering and cooking as well as skewering meat products without automation.

SUMMARY OF THE INVENTION

Accordingly, it is an object of the present invention to provide a mobile workstation which avoids the disadvantages of the prior art.

The mobile workstation for the preparation of skewered meat products of the present invention comprises a food preparation cart, a skewer bracket mounted on the cart and a rack member assembly also mounted on the cart. Optionally, skewer holders can also be mounted on the food preparation cart.

The mobile workstation of the present invention provides a compact location for effecting all tasks associated with the preparation of a meat product for rotisserie or skewered cooking. Accordingly, the mobile workstation includes the equipment necessary for storing skewers, preparing the meat product for skewering, effecting skewering of the meat product and preparing the meat product for cooking, i.e., seasoning.

Since the workstation of the present invention is mobile, rather than carrying each skewer with meat product thereon, several skewers can be prepared at a time and then the food preparation cart is moved to the rotisserie oven area at which time the skewers with meat products thereon are unloaded and loaded onto the rotisserie. Thus, the mobile workstation of the present invention can be located anywhere in the kitchen. Where large numbers of chicken are to be skewered, for instance, eight skewers with four whole chickens on each skewer, the cart can be rolled to a location adjacent the refrigerator for loading and skewering and then moved to the rotisserie area with a complete load for the rotisserie.

More particularly, the mobile workstation of the present invention comprises:

(a) a mobile food preparation cart, said cart having:
  (i) a work surface, said work surface supported by a plurality of leg supports on wheels, and
  (ii) rails for supporting a removable seasoning lug positioned below the work surface;

(b) a skewer bracket for receiving and positioning a skewer in a substantially vertical position for effecting skewering of said meat product on said skewer; and (c) a rack member assembly mounted on said cart for supporting a plurality of skewers or skewers and skewered meat products.

Optionally, the workstation includes a pair of skewer support holders also mounted on said food preparation cart.

On the work surface the meat product can be prepared for skewering. Such preparation can include cutting or shaping of the meat product. In the case of chicken such preparation can include trussing of the chicken. In one embodiment, the work surface can be removable to expose the removable seasoning lug. In a second embodiment the work surface can be formed such that a portion or all of the seasoning lug is exposed.

In an alternate embodiment the work surface can be a removable support, such as a bun pan, or cutting board, which provides a surface to prepare the meat product and protect the seasoning lug from drippings. In this embodiment the removable support is supported by horizontal supports of the food preparation cart.

The food preparation cart includes wheels or casters such that the cart itself can be moved from one point of a kitchen or restaurant to another point easily and quickly. In preferred embodiments, the wheels or casters include two fixed casters and two swivel casters having locked and unlocked positions. Such casters are manufactured from materials suitable to withstand grease and the cleaning and sanitizing chemicals and floor conditions typically found in restaurant kitchens.

Optionally, a shelf can be positioned between the wheels or casters and the work surface in a substantially horizontal position. If such a shelf is present the meat product can be unloaded from the refrigerator, freezer or the like, which may be located remote from the desired food preparation area, and placed on the shelf prior to the actual preparation of the meat product for skewering and cooking. This enables someone to chose the exact number of meat products intended to be skewered at a single time. For instance, if the intent is to prepare eight skewers with a single whole chicken on each skewer, eight whole chickens can be removed from the freezer or refrigerator and placed on the shelf. In the alternative, if four whole chickens are to be skewered on each skewer, 32 chickens can be placed on the shelf. The cart can then be moved, if necessary, to the location where the trussing, skewering and seasoning of such chickens is to take place.

The skewer bracket, which is mounted on the food preparation cart, allows a skewer to be secured vertically for placement of the meat product, such as a whole chicken, on the skewer with a downward motion starting at the top of the skewer. Means for quickly and easily inserting and removing a skewer into the skewer bracket are present on the skewer bracket so as to permit the efficient skewering of meat products. In a preferred embodiment the skewering bracket includes a rail for supporting a removable drip pan.

In one embodiment the skewer bracket comprises:

a cantilever bracket having a top portion and means for mounting said cantilever bracket to corresponding means on said cart such that said top portion is substantially level with said work surface, said top portion having means for affirmatively securing a skewer in a substantially vertical position to place a meat product thereon.

said cantilever bracket having rails for supporting a removable dripping and scrap pan positioned below said top portion.

The means for affirmatively securing a skewer in a substantially vertical position are preferably raised tabs under which the base of the skewer slides. A stop means can be mounted on the top portion so as to prevent the skewer from sliding out the other side of the raised tabs. Thus, in one preferred embodiment two raised tabs and a stop means secure the skewer in a substantially vertical position while a meat product is skewered thereon by downward force from the top of the skewer. Typically, the skewer will have a pointed top edge to facilitate the skewering and a round base.

In still another embodiment the top portion of the cantilever bracket includes openings through which shreds of meat and drippings pass through to the removable drip pan. To facilitate the passing of shreds of meat and drippings to the removable drip pan the top portion can be sloped toward the center.

In a preferred embodiment the means for mounting the cantilever bracket is a plurality of key hole slots on the bracket and the corresponding means on the cart is a plurality of studs which engage the key holes. In a second preferred embodiment the means for mounting is a plurality of long pins and the corresponding means is a plurality of cooperating apertures defined by said cart.

The rack member assembly of the present invention is mounted on the food preparation cart for supporting a plurality of skewers or skewers and skewered meat products. In a preferred embodiment at least two vertical posts are mounted on at least two leg supports of the food preparation cart such that the two vertical posts extend above the work surface of the food preparation cart. Removable or fixed bracket members are mounted on each vertical post such that rotisserie skewers can be extended therebetween. More than a single skewer or skewer and meat product can be extended between brackets. After the meat product has been skewered and prepared the skewer and skewered meat product can be placed on the rack while another skewer and skewered meat product is prepared. Subsequent to the skewering and preparation of a number of meat products and skewers, the food preparation cart with meat products on skewers and ready for the oven can be transported to the oven location.

In one embodiment four bracket members are mounted on each vertical post and each bracket member includes two positive indentations, thus, a total of eight skewers are prepared at a time. The positive indentations in the bracket members ensure that the skewered meat product will remain separated and secure during transport.

In a preferred embodiment the skewer bracket and rack member are completely removable for cleaning. This is particularly important with respect to food handling equipment which must be thoroughly cleaned in conformance with a multiplicity of local health department rules and regulations.

In still another preferred embodiment the cantilever bracket of the skewer bracket has a horizontal flange extending from the top portion such that the bracket is supported by the work surface and a first skewer support holder extends upwardly from the horizontal flange. A second skewer support holder can also be mounted on the food preparation cart on a side opposite that of the skewer bracket such that a skewer can be supported horizontally between the first and second skewer support holder such that after the meat product has been skewered the meat product is suspended above the work surface while seasoning is applied. The skewer support holders can be mounted on either end of the food preparation cart by means similar to that described for the skewer bracket and can be completely removable for cleaning.

Accordingly, it is a basic object of the present invention to provide a dedicated workstation for storing oven skewers, preparing meat products, such as chicken, skewering the meat product, adding seasoning to the meat product and moving the prepared skewers to the oven in a compact and cost-efficient manner.

BRIEF DESCRIPTION OF THE DRAWINGS

The foregoing and other object of the invention may now be more readily ascertained from the following detailed description of the preferred embodiments thereof, taken in conjunction with the accompanying drawings, in which.

DETAILED DESCRIPTION OF THE INVENTION

FIG. 1–14 illustrate the mobile workstation for the preparation of skewered meat products of the present invention. While the invention will be described and illustrated with respect to chicken meat products, it is understood that the invention is equally applicable to other types of meat products.

Figure 1:
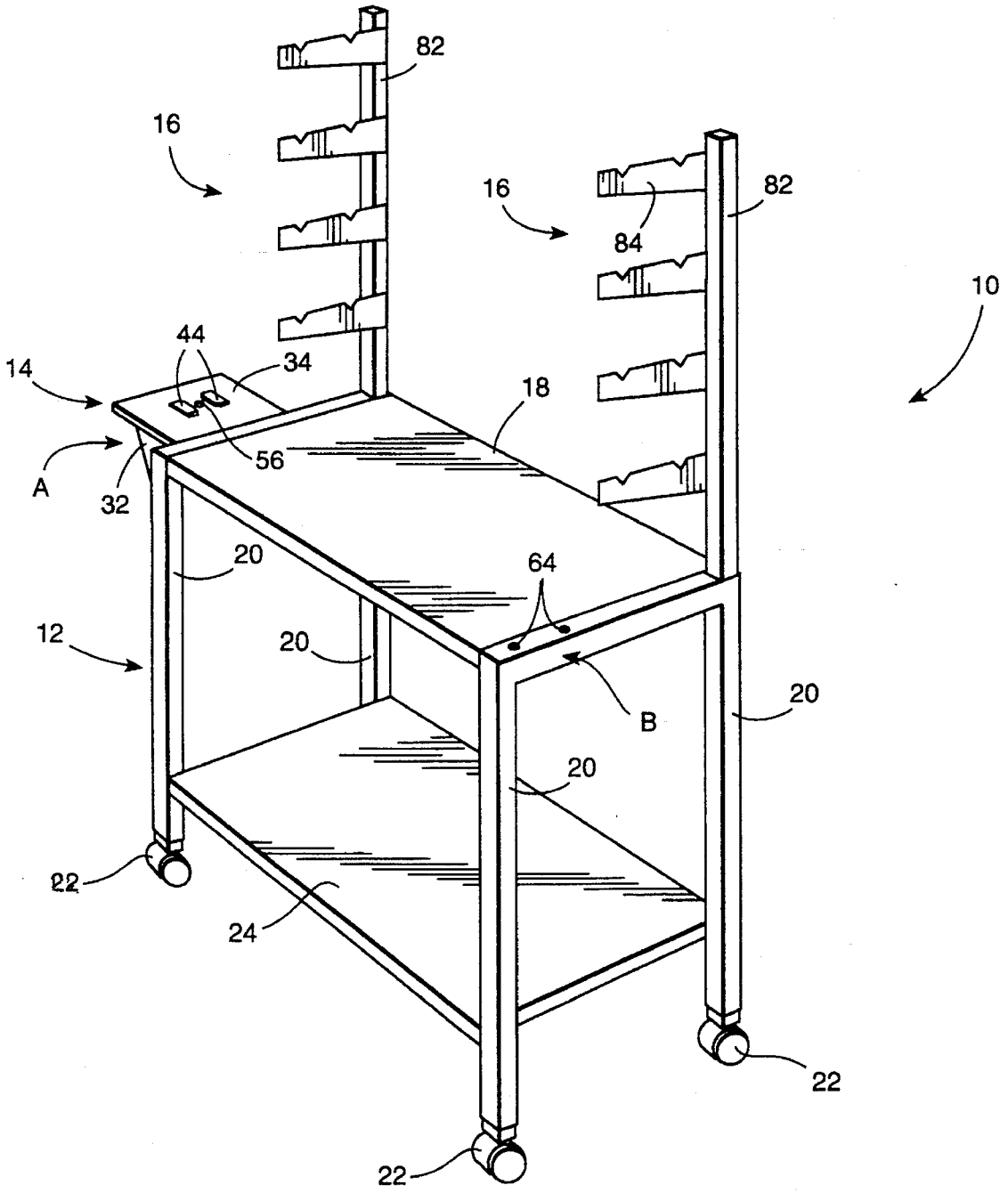
FIG. 1 is a perspective view of the mobile workstation of the present invention.

Referring now in detail to the drawings, and particularly, the mobile workstation construction of FIG. 1, there is illustrated a perspective view of a mobile workstation 10 comprising a mobile food preparation cart 12, a skewer bracket 14 and a rack member 16. The food preparation cart 12 includes a work surface 18 which is supported by a plurality of leg supports 20 on wheels 22. The work surface 18 can be used, for instance, to truss and or trim a chicken before the chicken is placed on a skewer.

Due to the forces which will be applied to the cart during the skewering process, the food preparation cart is preferably constructed such that when the casters are in a locked position a 50 lb. horizontal force cannot move the cart in any direction and, further, a 200 lb. vertical point load will not cause permanent deformation.

In one embodiment a shelf 24 is present on the cart 12. Shelf 24 may be used to support the meat product to be skewered after it is removed from the refrigerator freezer or to store another product. The shelf is preferably constructed to support at least 100 lb. case of chicken.

Figure 2:
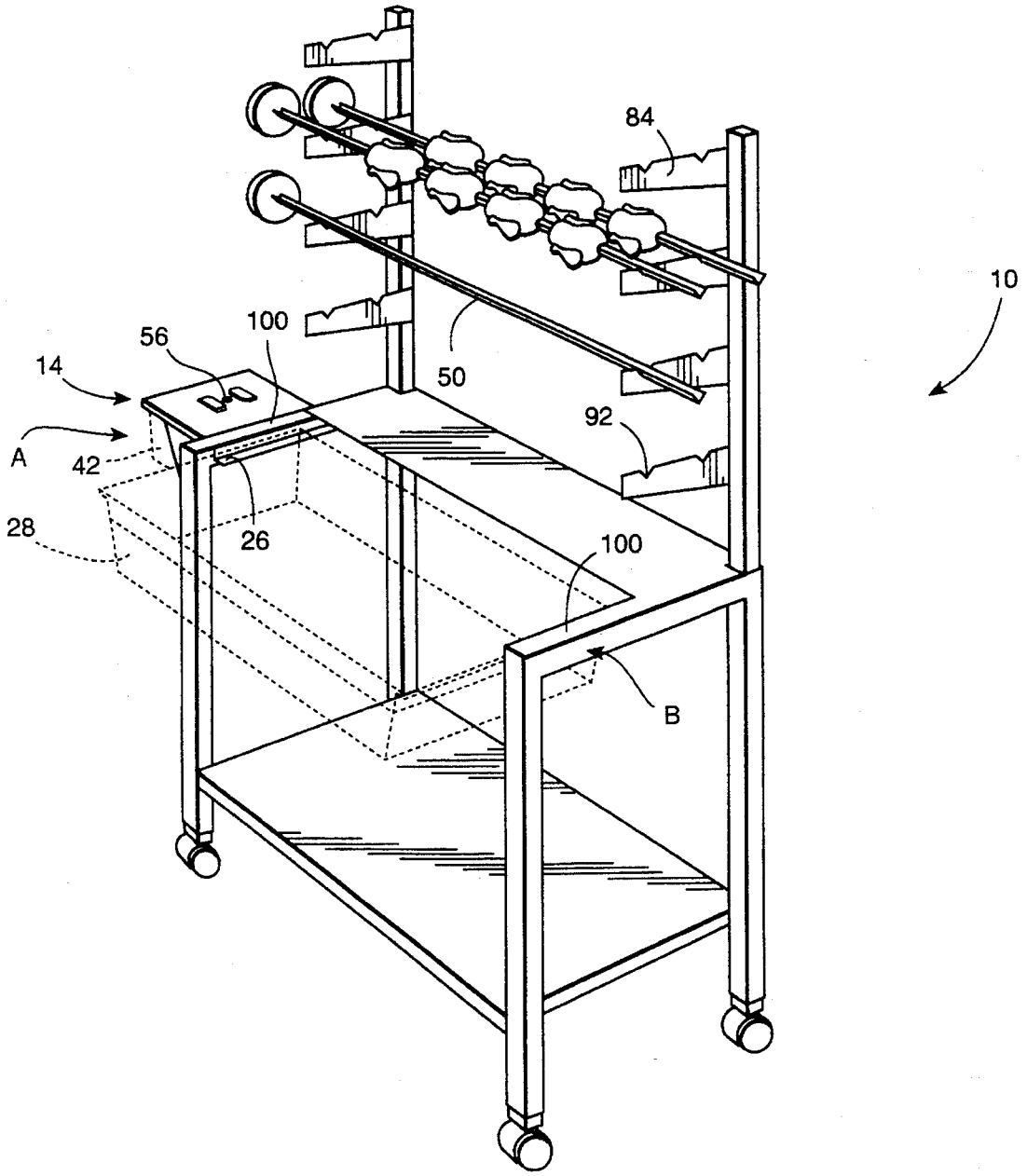
FIG. 2 is a perspective view of a second embodiment of the mobile workstation of the present invention showing the lug in phantom lines.

FIG. 2 depicts a second embodiment of the mobile workstation of the present invention, wherein a portion of the work surface 18 has been removed to expose the seasoning lug. Horizontal supports 100 are exposed which can support a removable support such as a bun pan or cutting board in the preparation of the meat product. Channel rails 26 for supporting a removable seasoning lug 28 (shown in phantom lines) are positioned on the cart 12. The work surface 18 or the removable support (if required) protects the contents (i.e., seasoning) of the lug 28 from meat or chicken drippings. Lug 28 slides out completely for removal or partially (as shown in FIG. 2) for application of a seasoning to the meat product.

Figure 3:
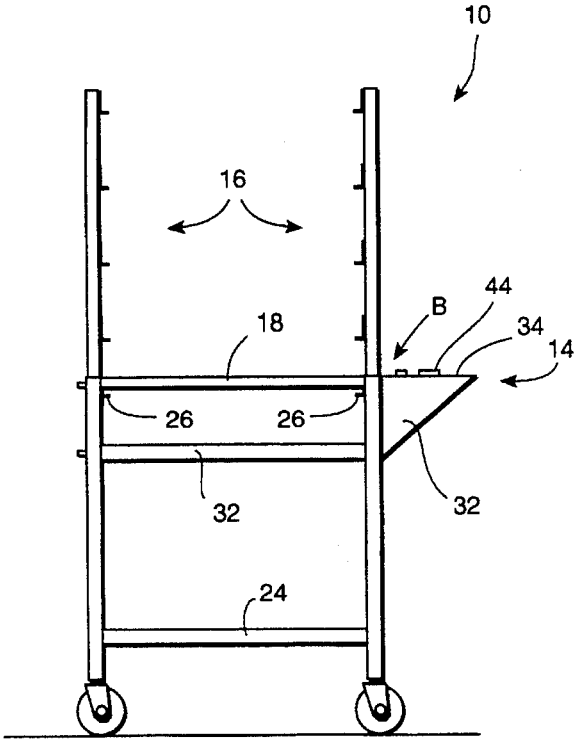
FIG. 3 is a front elevational view of the mobile workstation depicted FIG. 1 showing the skewer bracket mounted on the opposite side of the food preparation cart.

Rails 26 are also depicted in the front elevational view of the workstation of the present invention depicted in FIG. 3. An additional support 32 can be present on the food preparation cart 12 located at a position which does not interfere with the sliding and removal of the lug 28.

The skewer bracket 14 for receiving and positioning a skewer in a substantially vertical position for effecting skewering of a whole meat product on a skewer is mounted on the frame of the food preparation cart 12 at, for instance, Point A as depicted in FIGS. 1 and 2. In a different embodiment skewer bracket 14 can also be mounted, for instance, at Point B of the food preparation cart as depicted in the FIG. 3. The cantilever bracket 32 has rails 54 (not shown in FIGS. 1 or 2 but shown in FIGS. 5 and 8) for supporting a removable dripping and scrap pan 42 (shown in FIG. 2 in phantom line) positioned below a top portion 34 of the skewer bracket 14.

As illustrated in FIG. 3 in one preferred embodiment, skewer bracket 14 is a cantilever bracket 32 having a top portion 34 and means (depicted in FIGS. 5 and 8) for attaching said cantilever bracket 32 to corresponding means (depicted in FIGS. 1 and 4) on said cart 12 such that said substantially horizontal portion is substantially level with said work surface 18 or horizontal support 100. Top portion 34 has means 44 for affirmatively securing a skewer 50 (depicted in FIGS. 6 and 13) in a substantially vertical position to place a meat product, such as a whole chicken, thereon. In a particularly preferred embodiment the skewer bracket 14 is easily removed from the cart 12 for cleaning.

In a second preferred embodiment, as is most clearly depicted in FIGS. 5-10 means 36 on the top portion 34 of the skewer bracket 14 are restraint tabs 44. As is most clearly illustrated in FIGS. 6 and 14, skewer stop 46 can also be mounted on the top portion 34 to secure and restrain the base 52 of the skewer 50 from sliding through the restraint tabs 44.

Top portion 34 is preferably sloped and includes at least one opening 56 through which shreds of meat and drippings pass to the removable dripping pan 42 which is positioned below the top portion.

The skewer bracket is preferably capable of sustaining at least 150 lbs. of downward force on the skewer and 100 lbs. of lateral force at the top of the skewer without permanent deformation or movement from the supporting food preparation cart.

Figure 5:
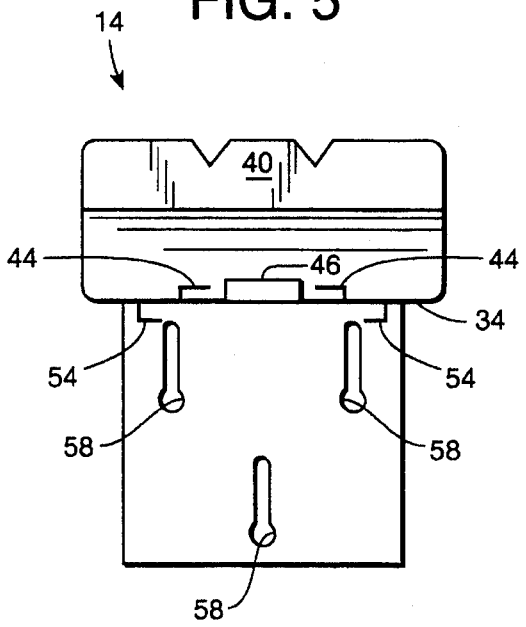
FIG. 5 is a front elevational view of one embodiment of the skewer bracket of the present invention.
Figure 6:
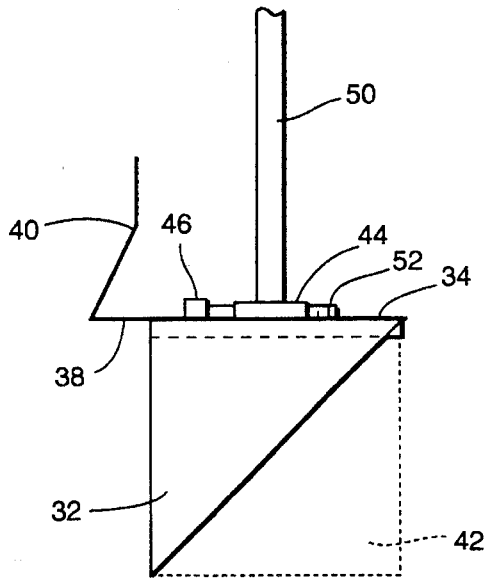
FIG. 6 is a left end elevational view of the skewer bracket depicted in FIG. 5 with a skewer secured therein.
Figure 7:
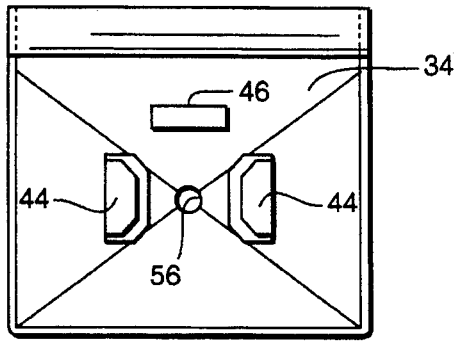
FIG. 7 is a top view of the skewer bracket depicted in FIG. 5.

Preferred embodiments of the skewer bracket 14 are illustrated in FIGS. 5–10. FIGS. 5–7 depict a first preferred embodiment of the skewer bracket 14 of the present invention. As is most clearly depicted in FIG. 6 the skewer bracket 14 is cantilevered out from the cart 12 and has in addition to a top portion 34 with skewer stop 46 and restraint tabs 44, a horizontal flange 38 to be supported by said work surface 18. A first skewer holder 40 extends upwardly from said horizontal flange 38.

Figure 4:
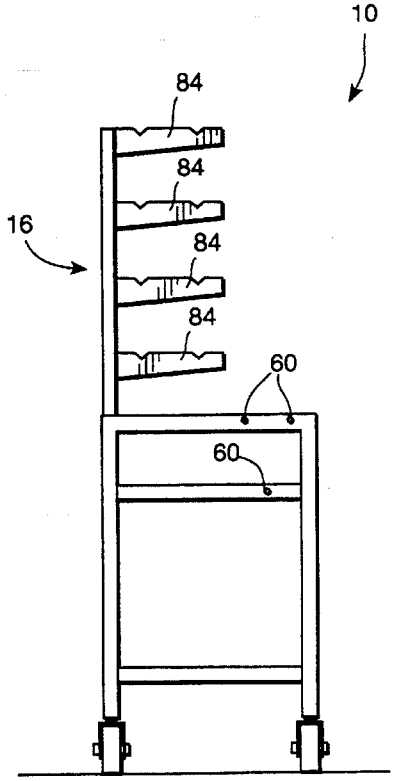
FIG. 4 is a left end elevational view of the mobile workstation depicted in FIG. 3 without the skewer bracket.

Also most clearly depicted in FIG. 5 is one means for mounting the skewer bracket 14 to the food preparation cart 12. The means shown in FIG. 5 is a plurality of key hole slots 58. Corresponding means on the food preparation cart 12 are depicted in FIG. 4 wherein a plurality of studs 60 for engaging the keyholes are shown. The key hole slots are placed over the studs and then slid down to lock into place. To remove the skewer bracket from the food preparation cart for cleaning one need only slide the bracket in an upward direction to release skewer brackets from the fixed studs.

Figure 8:
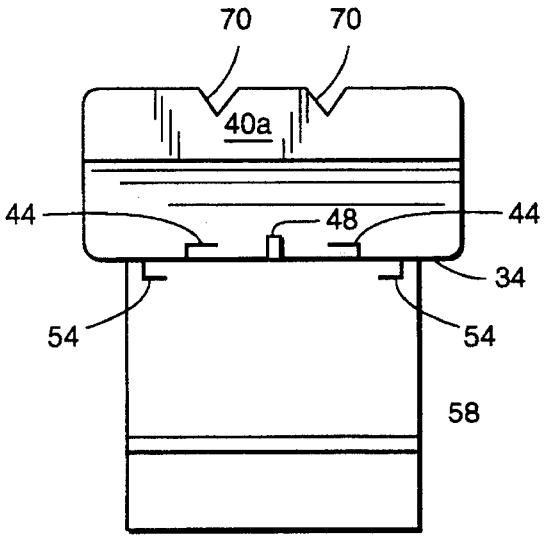
FIG. 8 is a front elevational view of a second embodiment of the skewer bracket of the present invention.
Figure 9:
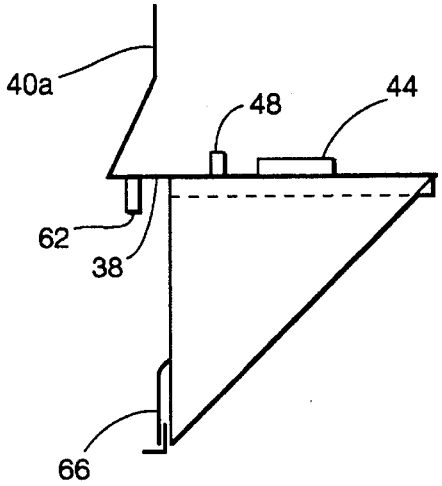
FIG. 9 is a left end elevational view of the skewer bracket depicted in FIG. 8.
Figure 10:
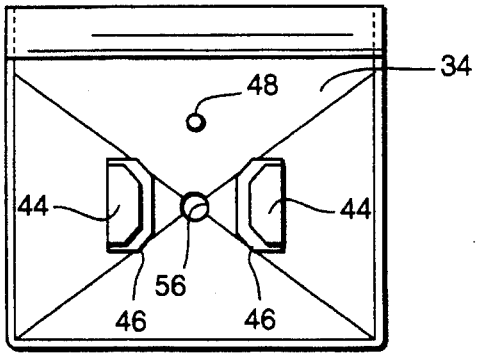
FIG. 10 is a top view of the skewer bracket depicted in FIG. 8.

FIGS. 8–10 depict a second preferred embodiment of the skewer bracket 14 of the present invention using a second means for mounting the skewer bracket 14 to the food preparation cart 12. The means shown in FIG. 9 uses a combination of long pins 62 which cooperate with apertures 64 defined on said food preparation cart (as shown in FIG. 1) and brackets 66 to secure the bracket to the cart for skewering. It will be noted that the embodiment of the skewer bracket depicted in FIGS. 8–10 also includes a horizontal flange 38 to be supported by said work surface 18 and a first skewer holder **40*a* extending upwardly from said horizontal flange 38**.

In a preferred embodiment the first skewer holder **40*a* is intended to cooperate with a second skewer holder 40*b*** which forms a portion of a second skewer support 80 mounted on the opposite side of the food preparation cart. Thus, one skewer holder is located at each of the A and B positions identified in FIGS. 1 and 2 and one or more skewers and skewered meat products extend therebetween. In this position the skewered meat products are quickly and easily rotated for seasoning (from lug 28, for example). The second skewer holder 40*b* need not be formed with the skewer bracket but can be a separate element, such as the second skewer support 80 depicted in FIGS. 11 and 12.

Figure 11:
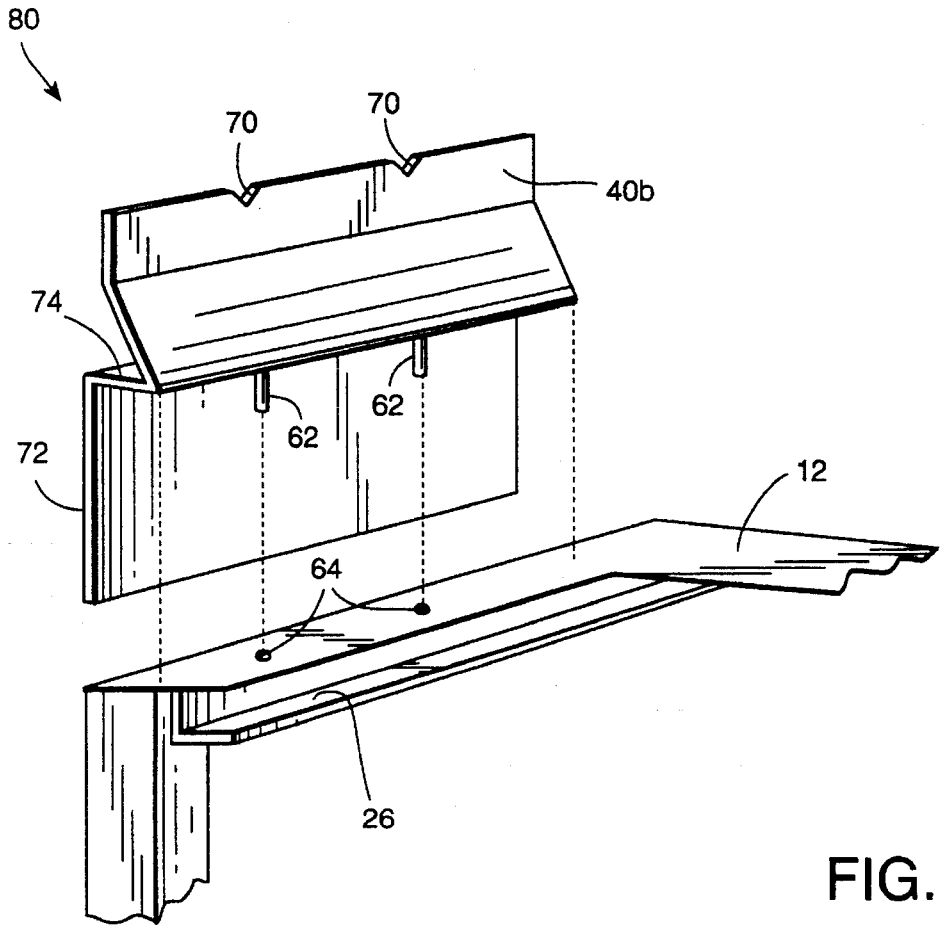
FIG. 11 is a perspective view of the second skewer holder of the present invention and a portion of the mobile food preparation cart.
Figure 12:
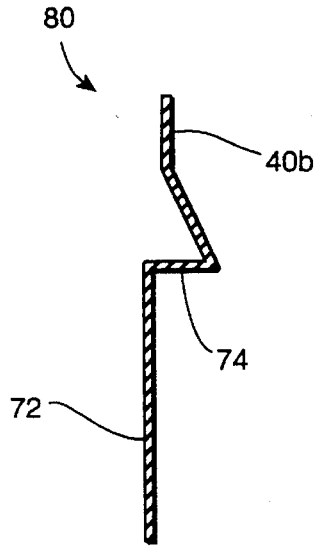
FIG. 12 is a sectional view of the second skewer holder shown in FIG. 11.
Figure 13:
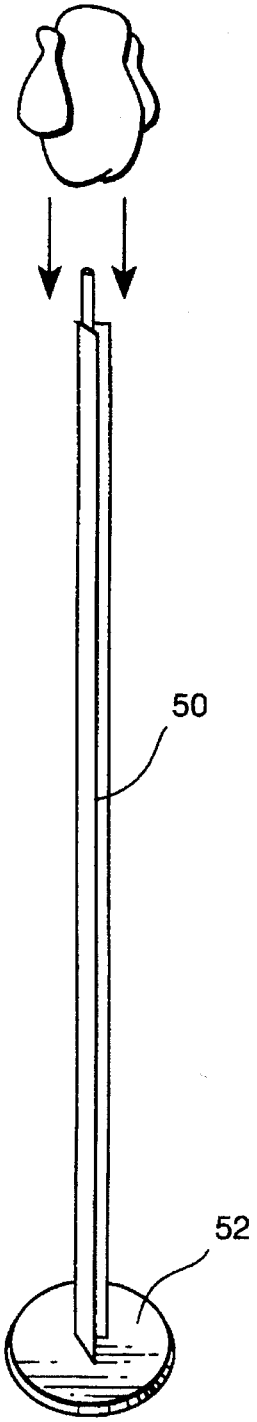
FIG. 13 is a perspective view of one embodiment of a skewer.
Figure 14:
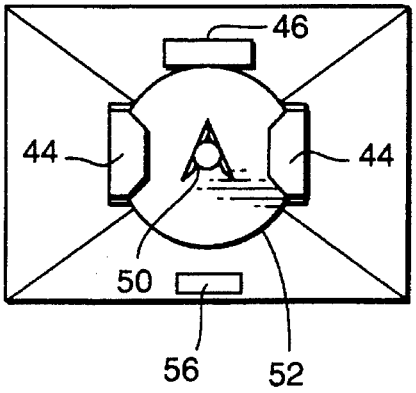
FIG. 14 is a top view of one embodiment of the skewer bracket with a skewer secured therein.

FIG. 12 illustrates a cross-sectional view of a preferred embodiment of the second skewer support 80 of the present invention. The second skewer support 80 has a vertical portion 72 which extends into a substantially horizontal portion 74 which extends upwardly into a second skewer holder 40*b*. In FIG. 11 a perspective view of the second skewer support 80 is depicted in conjunction with a portion of the food preparation cart. Long pins 62 which cooperate with apertures defined on the food preparation cart 12 securedly mount the second skewer support 80 in FIG. 11. It will be noted that FIG. 11 clearly depicts one portion of a pair of rails 26 for supporting lug 28. Although not depicted, the second skewer support can be constructed with key hole slots that cooperate with studs on the food preparation cart for mounting.

In one embodiment, as depicted most clearly in FIGS. 5, 8 and 11 the first and second skewer holders include indentations 70 for receiving skewers or skewers and skewered meat products. These are particularly useful for rotating the skewer by hand while applying seasoning and securing the skewers or skewers and skewered meat products while the food preparation cart is in transit.

Rack member assembly 16 of the present invention is intended to support a plurality of skewers or skewers and skewered meat products. See FIGS. 1 and 2. In a preferred embodiment at least two vertical posts 82 are mounted on at least two leg supports 20 of the food preparation cart such that the two vertical posts 82 extend above the work surface 18 of the food preparation cart. Bracket members 84 are mounted on each vertical post 82 such that rotisserie skewers can be extended therebetween. Bracket members 84 can be either removably or fixedly mounted. Due to the weight of the skewers and skewered meat products, the rack member assembly is preferably constructed to accommodate at least a 200 lb. vertical point load or the support of any skewer location and at least a 50 lb. horizontal force at any point on the chicken rack. In a particularly preferred embodiment rack member assembly 16 is removable.

As depicted in FIG. 2, more than a single skewer 50 or skewer and skewered meat product 90 can be extended between the bracket members 84. After the meat product has been skewered and prepared the skewer and skewered meat product can be placed on the rack member assembly while another skewer and skewered meat product is prepared. Subsequent to the skewering and preparation of a number of meat products and skewers, the food preparation cart with meat products on skewers which are ready for the rotisserie can be transported to the rotisserie location.

In one embodiment as depicted in FIG. 2 four bracket members 84 are mounted on each vertical post 82 and each bracket member includes two positive indentations 92, thus, at least eight skewers can be prepared at a time.

The mobile workstation of the present invention can be formed from any suitable material, but in a preferred embodiment the mobile food preparation cart, rack member, skewer bracket and, optionally, skewer holders are made from food grade 304 stainless steel. Seasoning lug 28 and pan 42 can optionally be made of plastic or other suitable material.

While there have been shown and described what are considered to be the preferred embodiments of the invention, it will, of course, be understood that the various modifications and changes in form or detail can be readily made without departing from the spirit of the invention. It is therefore intended that the invention not be limited to the exact form and detail herein shown and described nor to anything less than the whole of the invention herein disclosed as hereinafter claimed.

What is claimed is:

1. A mobile workstation for preparation of skewered meat products comprising:

(a) a mobile food preparation cart, said cart having
  (i) horizontal supports, said horizontal supports supported by a plurality of leg supports on wheels,
  (ii) rails for supporting a removable seasoning lug;

(b) a skewer bracket for receiving and positioning a skewer in a substantially vertical position for effecting skewering of said meat product; and (c) a rack member assembly mounted on said cart for supporting a plurality of skewers or skewers and skewered meat products.

2. The workstation of claim 1, wherein said meat products are chicken.

3. The workstation of claim 1, wherein said cart further comprises a substantially horizontal shelf member positioned between said wheels and said horizontal supports.

4. The workstation of claim 1, wherein said skewer bracket and said rack member assembly are each removable.

5. The workstation of claim 1, wherein said skewer bracket comprises:

a cantilever bracket having a top portion and means for mounting said cantilever bracket to corresponding means on said cart such that said top portion is substantially level with said horizontal supports said top portion having means for affirmatively securing a skewer in a substantially vertical position to place a meat product thereon, said cantilever bracket having rails for supporting a removable dripping and scrap pan positioned below said top portion.

6. The workstation of claim 5, wherein said cantilever bracket has a horizontal flange extending from said top portion, such that said bracket is supported by at least one of said horizontal supports and a first skewer support holder extends upwardly from said horizontal flange, and a second skewer support holder is mounted to said cart on an opposing side such that a skewer and skewered meat product can be supported by said first and second skewer holders in a substantially horizontal position while said meat product is seasoned, said second skewer support holder including means for attaching said second skewer support holder to corresponding means on said cart.

7. The workstation of claim 5, wherein said means for affirmatively securing a skewer in a substantially vertical position comprises a skewer stop and skewer restraint tabs formed on said top portion of said bracket.

8. The workstation of claim 5, wherein said means for mounting said cantilever bracket is a plurality of key hole slots and said corresponding means on said cart is a plurality of key hole studs.

9. The workstation of claim 5, wherein said means for mounting said cantilever bracket are a plurality of long pins and said corresponding means on said cart is a plurality of apertures to accommodate said long pins.

10. The workstation of claim 7, wherein said means for mounting said second skewer support holder is a plurality of key hole slots and said corresponding means on said cart is a plurality of key hole studs.

11. The workstation of claim 7, wherein said means for mounting said second skewer support holder is a plurality of long pins and said corresponding means on said cart is a plurality of apertures to accommodate said long pins.

12. The workstation of claim 1, wherein said plurality of leg supports on wheels comprises four leg supports on wheels.

13. The workstation of claim 12, wherein said wheels comprise two swivel wheels, each of said swivel wheels having locked and unlocked positions, and two straight wheels.

14. The workstation of claim 1, wherein said rack member assembly comprises:

(a) at least two vertical posts mounted on at least two leg supports from said plurality of leg supports such that said vertical posts extend above said horizontal supports of said food preparation cart; and (b) bracket members mounted on each of said vertical posts such that rotisserie skewers can be extended therebetween.

15. The workstation of claim 14, including four bracket members.

16. The workstation of claim 14, wherein said bracket member includes at least one indentation to affirmatively secure said skewer or skewer and skewered meat product.

17. The workstation of claim 14, wherein said vertical posts are removably mounted.

18. The workstation of claim 14, wherein said bracket members are removably mounted.

19. A mobile workstation for preparation of skewered meat products comprising:

(a) a mobile food preparation cart, said cart having
  (i) a work surface, said work surface supported by a plurality of leg supports on wheels,
  (ii) rails for supporting a removable seasoning lug positioned below said work surface;

(b) a skewer bracket for receiving and positioning a skewer in a substantially vertical position for effecting skewering of said meat product; and (c) a rack member assembly mounted on said cart for supporting a plurality of skewers or skewers and skewered meat products.

20. The workstation of claim 19, wherein said skewer bracket extends upwardly to form a first skewer support holder and a second skewer support holder is mounted to said cart on a opposing side such that a skewer and skewered meat product can be supported by said first and second skewer holder in a substantially horizontal position for seasoning.

* * * * *